United States Patent [19]

Mazzone

[11] 4,109,356

[45] Aug. 29, 1978

[54] PROCESS FOR TEXTURING SYNTHETIC FIBROUS MATERIAL

[75] Inventor: Charles P. Mazzone, Dover, N.J.

[73] Assignee: J. P. Stevens & Co., Inc., New York, N.Y.

[21] Appl. No.: 757,416

[22] Filed: Dec. 30, 1976

[51] Int. Cl.[2] ..... D02G 1/14

[52] U.S. Cl. ..... 28/279; 28/178; 28/258; 57/157 MS

[58] Field of Search ..... 28/1.8, 72.15, 278, 28/279, 258, 178; 57/157 MS; 26/69 R; 72/196

[56] References Cited

U.S. PATENT DOCUMENTS

| | | | |
|---|---|---|---|
| 448,073 | 3/1891 | Price | 72/196 |
| 1,602,049 | 10/1926 | Somers | 72/196 |
| 1,678,941 | 7/1928 | Helman | 72/196 |
| 3,247,785 | 4/1966 | Shultz | 26/69 R |
| 3,345,718 | 10/1967 | Hollihan et al. | 28/1.8 |
| 3,611,522 | 10/1971 | Daniels et al. | 28/279 X |
| 3,725,985 | 4/1973 | Yarber | 28/279 |

FOREIGN PATENT DOCUMENTS

| | | | |
|---|---|---|---|
| 7,001,914 | 8/1970 | Netherlands | 28/278 |

*Primary Examiner*—Louis K. Rimrodt

*Attorney, Agent, or Firm*—Michael T. Frimer; Charles Stein

[57] ABSTRACT

A plurality of synthetic fibrous textile materials such as polymeric yarns and staple fibers are textured by a procedure which imparts a variety of spaced deformations in a random sequence. The fibrous textile materials are fed between two opposed pressure surfaces, one of which has a raised pattern of closely spaced pyramids while the other is made of a resilient material having a meshing pattern of pyramid shaped depressions. The textile material is maintained at an elevated temperature during its passage between the pressure surfaces and is then cooled to give a permanently textured product.

12 Claims, 4 Drawing Figures

FIG. 3
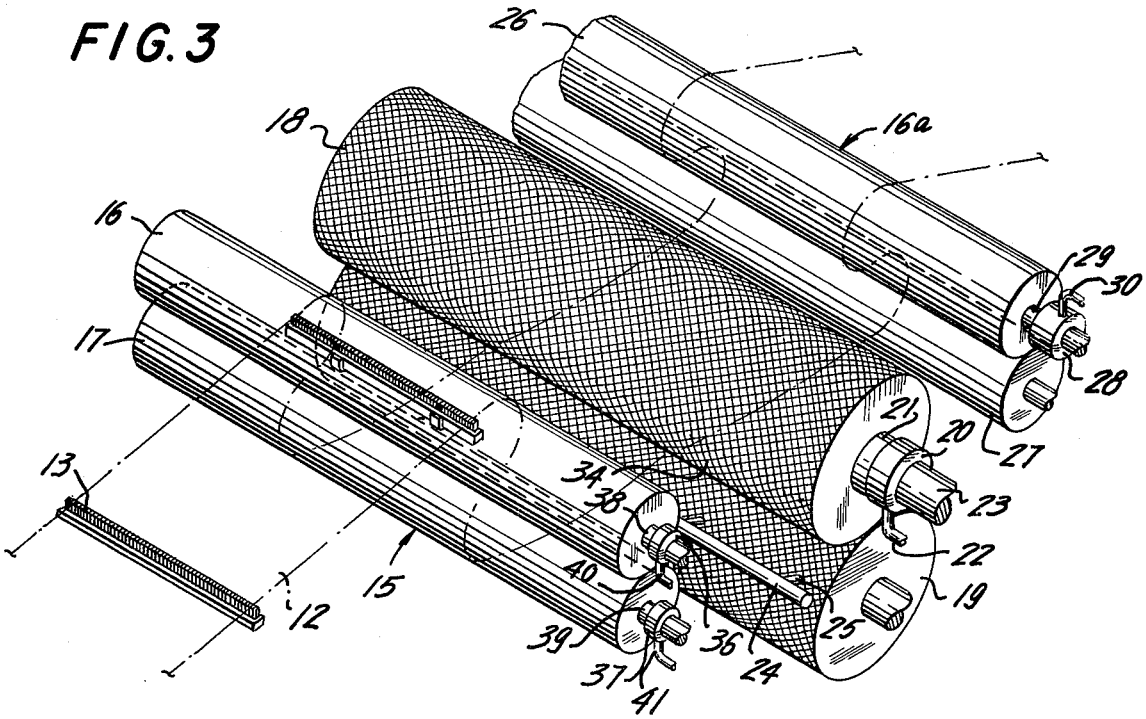
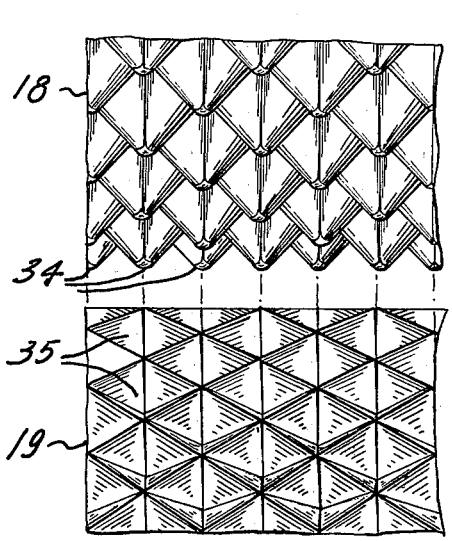
FIG. 4

PROCESS FOR TEXTURING SYNTHETIC FIBROUS MATERIAL

FIELD OF THE INVENTION

This invention relates to texturing fibrous textile material by passing it between patterned pressure surfaces.

BACKGROUND OF THE INVENTION

It is well known to treat textile yarns and fibers of synthetic material such as nylon and polyester in order to change their properties to be closer to those of natural fibers such as wool and cotton. These natural fibers are characterized by inherent crimp and short fibers which impart bulk, pleasant hand, the ability to breathe, insulating properties, good moisture absorption and other desirable properties.

In U.S. Pat. No. 3,345,718 there is disclosed a process for texturing fibrous textile material in which the material is fed in a substantially tensionless state between a set of opposed pressure surfaces having a meshing system of grooves which deform the fibrous material into a crimped, zigzag configuration in which the fibrous material is twisted in alternate directions in the regions of the apices of the crimps. When synthetic fibrous materials are treated by the process of this patent the resulting crimping makes the properties of the product more like those of natural fiber products. However, there are still substantial differences between such synthetic fiber products and textile products of natural fibers.

SUMMARY OF THE INVENTION

The present invention relates to a process and apparatus for texturing synthetic fibrous materials which impart properties more closely resembling those possessed by natural fibers than the properties imparted by previously known procedures. In accordance with the present invention, a plurality of synthetic fibrous textile materials are fed between a set of opposed pressure surfaces which form a pressure applying zone while heating the textile material. One of the pressure surfaces is made of non-resilient material and has thereon a raised pattern of closely spaced pyramids, while the second surface is made of a resilient material and has a pattern of closely spaced pyramid shaped depressions which mates with the raised pattern of the first surface. The synthetic fibrous textile materials are deformed in different ways depending upon the particular part of the pyramid pattern causing the deformation and consequently products are obtained having a random sequence of different deformations along their length.

BRIEF DESCRIPTION OF THE DRAWINGS

FIG. 3 is a perspective view of a set of pressure rollers for imparting deformations of textile material according to this invention.

FIG. 4 is an enlarged detail showing the raised pattern of pyramids on the non-resilient roll and the mating pattern of pyramid shaped depressions in the resilient roll.

DETAILED DESCRIPTION OF THE INVENTION

Figure 1:
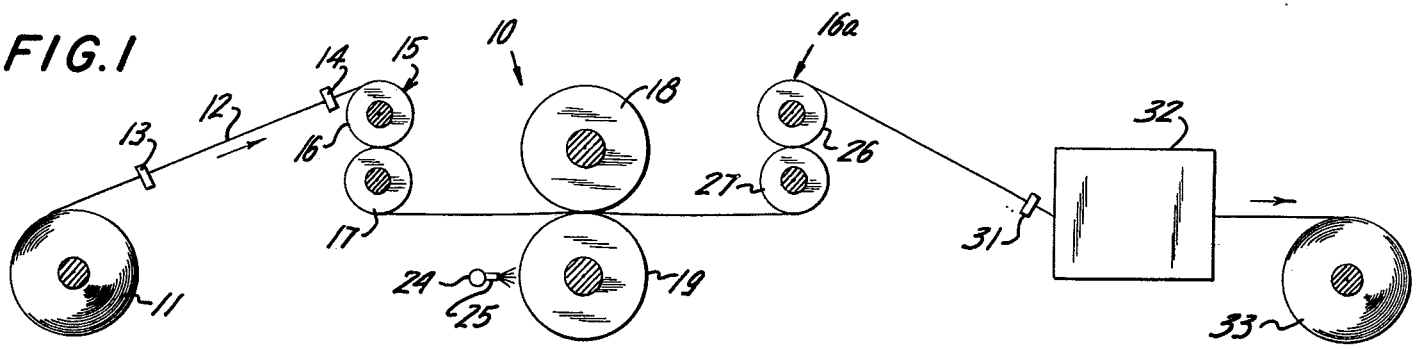
FIG. 1 is an elevational schematic view of one embodiment of an apparatus of the present invention.
Figure 2:
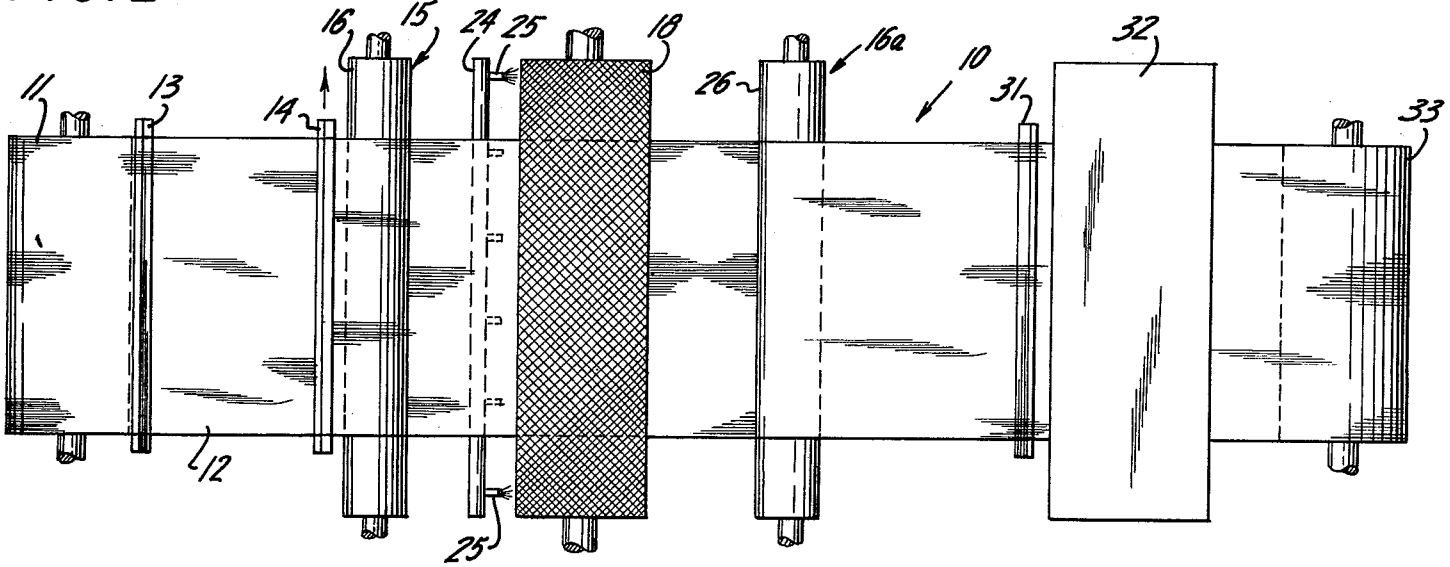
FIG. 2 is a plan view of the apparatus of FIG. 1.

Referring to FIGS. 1 and 2, there is shown an embodiment of an apparatus, generally designated as 10, which is suitable for treating synthetic fibrous textile material in accordance with the present invention. In the embodiment shown, a large number of yarns 12 are fed in spaced, side-by-side relationship from a beam 11 which is supported by journal means, not shown, and is free-running but provided with a friction drag or other suitable device to provide uniform tension in the yarns on the beam.

The yarns 12, pass through a reed 13 supported by a means not shown. Subsequently, the yarns 12 pass through a reed 14 which is suitably adapted to traverse in a well-known manner the path of the materials horizontally in a direction substantially perpendicular to the path of travel.

The yarns 12 then pass through overfeed mechanism 15 comprising two relatively small diameter rolls 16 and 17, the yarns being S-looped about the rolls 16 and 17 both of which are driven by means not shown. Generally, any suitable combination of rolls and driving arrangement may be utilized to provide the overfeed. The yarns 12 then pass between a set of opposed pressure surfaces illustrated as a pair of pressure rolls 18 and 19. The number of opposed surfaces may be greater than two, however. Roll 18 is fabricated from a relatively hard material, such as steel, and roll 19 is made of a resilient and also softer material, such as disclosed more fully hereinafter. In any case, the relatively hard roll or rolls have a surface configuration or pattern which is designed to impart a deformation to the yarns 12 as well as to impart the particular surface contours thereof to the softer resilient roll 19.

The configurations or patterns of the pressure surfaces are an important aspect of the present invention and are responsible for the different product properties obtained as compared with the product of U.S. Pat. No. 3,345,718. As shown in FIG. 4, roll 18 has a raised pattern of pyramid-shaped projections 35. Preferably, these patterns contain from 100 to 300 pyramids per linear inch and the sides of the pyramids are at an angle of about 30° to 60° to the base. It is also preferable that the tops of the pyramids be rounded off or truncated and that the base of each of the pyramids is a square, the sides of which are at an angle of 45° to the feeding direction of the textile material. Roll 19 has a pattern of pyramid-shaped depressions 34 which is complementary to and mates with the pattern of projections of roll 18. When a yarn is fed between rolls 18 and 19 there is imparted a random series of different deformations or distortions, including twists, bends and flattened areas, the individual deformations being dependent on the particular portion of the pyramid pattern acting on the yarn. The product obtained from the above pressure rolls is quite different from that obtained using the pressure roll patterns of U.S. Pat. No. 3,345,718. Not only is there a random distribution of many different types of deformations, but the deformations are much more pronounced.

The surfaces of rolls 18 and 19 are in contact and form a pressure applying zone. This state or condition of pressure is attained and maintained by hydraulic or other means through any suitable arrangement and generally by forcing the lower roll against the upper roll. Roll 18 is rotated by means not shown and roll 19 is driven as a result of the frictional force resulting from the pressure contact with roll 18.

Roll 18 can be heated, for example, by passing heated fluid through the center thereof. In such a case, roll 18 is preferably constructed of a heat conductive material. There is shown in FIG. 3 a stationary journal member 20 communicating with the interior of the hollow rotating shaft 21 of roll 18. A hose 22 from a source of heated fluid, not shown, is connected to journal 20. Extension 23 of shaft 21 is connected to the drive means of rotating roll 18. In this manner, heated fluid can be supplied to roll 18 while it is rotating.

Since roll 19 is resilient and in order to prevent it from overheating and thereby wearing excessively, there is provided means to cool it with an air blast, such as tube 24 having a plurality of air outlets 25. Tube 24 is connected to a supply of compressed air not shown.

The take-up assembly, generally designated as **16*a*, comprises rolls 26 and 27 and is capable of maintaining the yarns 12 under controlled tension until they are cooled sufficiently to retain substantially permanently the deformations imparted thereto. Both rolls 26 and 27 are driven by means not shown. Any suitable take-up assembly may be used for this purpose. Moreover, the take-up rolls may comprise a set of rolls which can be greater than two in number if desirable. In addition, it is to be noted that either one or both of the take-up rolls 26 and 27 can be utilized to provide positive cooling means for cooling the yarns being processed. This is shown in FIG. 3 wherein a journal 28 rotatably receives the hollow shaft 29 of roll 26 through which a supply of coolant from a source not shown is fed by way of hose 30. It will be understood that if this means of cooling is utilized, roll 26 will be fabricated from a material which is capable of conducting heat. It should be further understood, however, that the textile material being treated may be cooled sufficiently to achieve substantially permanent configuration of the deformation therein solely as a result of ambient heat exchange. Therefore, rolls 26 and 27** would not have to be adapted for cooling purposes.

Alternative methods of cooling are also possible, such as passing the yarns being treated while in a tensionless condition or state through an atmosphere which is maintained at a low ambient temperature. Regardless of the particular method of cooling utilized, the cooling should be accomplished before the yarns are exposed to tension forces which tend to remove or pull out the deformations imparted thereto by rolls 18 and 19.

The overfeed assembly, generally designated as 15, is required when the apparatus of the invention is used to treat yarns, since it is necessary to overfeed the yarns in order to relieve the tension in the yarns as they enter the nip of the rolls 18 and 19. As the yarns pass between these rolls, they are deformed in accordance with the raised and depressed areas of the surfaces thereof. The overfeed provides reserve length to compensate for both deformations such as bends and crimps which reduce the yarn length, and shrinkage of the yarn resulting from the application of heat. This not only helps to eliminate breakage of the yarn, but minimizes stretching during deformation, which reduces the degree of deformation in the final product. The amount of overfeed can be varied but preferably is adjusted so that the feed rolls 16 and 17 provide a linear velocity of about 0.3 to 10% greater than the peripheral speed of driven roll 18.

After the yarns have passed between the deforming mechanism, that is, roll 18 and 19, as mentioned hereinbefore, they are taken up on the take-up assembly **16*a* under controlled tension, preferably in a substantially tensionless condition, so that the deformations in the yarn are not pulled out or otherwise removed by tension forces. While take-up is being accomplished, the yarns, as mentioned before, are cooled and thereafter they may be subjected to the degree of tension which is necessary to carry out the balance of any operation. For example, the yarns 12 can pass through reed 31 after leaving the take-up assembly 16 and then to a finishing operation generally denoted by reference number 32 in FIG. 1. This finishing operation may involve sizing of the material or some other such operation. Finally, the yarns are wound on beam 33** which is rotated by means not shown and they are now ready for knitting, weaving or other fabricating processes.

With respect to roll 18, it is to be noted, as mentioned hereinbefore, that it is fabricated from a relatively hard material such as steel, whereas roll 19 is made of a resilient material. The surface of the hard roll is contoured by engraving or other similar procedures by which the desired pattern is cut into its surface. On the other hand, the resilient roll 19 is constructed of a suitable compacted composition or the like which has a durometer hardness in a range of about 72 to 100, and preferably in a range of from about 80 to 86. (See ASTM Designation D 1484–59). For example, the resilient roll 19 can be suitably fabricated from a blend of about 65% cotton and 35% wool, which is resin-impregnated and pressed to have a durometer hardness in the ranges expressed hereinabove.

A convenient method of shaping or contouring the surface of the deformable resilient roll follows. Initially, the surface of the roll is wetted by sponging and the hard roll, that is, roll 18, is heated to a temperature of approximately 125° C. after which the resilient roll is forced against the hard roll under pressure of about 240 pounds per linear inch. The hard roll 18 is then driven at a linear velocity of approximately 50 feet per minute for a period of approximately 15 minutes. The resilient roll 19 is then released from contact with the roll 18 and is wetted once more. The temperature of roll 18 is increased to approximately 150° C. and the resilient roll is once more pressed against it under a pressure of about 400 pounds per linear inch. Once again the roll 18 is driven at a linear speed of approximately 50 feet per minute for a period of about 15 minutes. The procedure is then repeated as often as necessary using increasing pressures until the contour of the roll 18 is substantially impressed or formed upon the surface of the roll 19.

The resiliency of roll 19 helps to prevent breaking or cutting of the yarns passing between the rolls. The use of a resilient roll helps to avoid the build-up of undesirable excessive pressure by sharing the pressure load. In other words, excessive pressure at any point or area between the surfaces of the rolls is relieved since the resilient roll will deform. This prevents any undue strain upon the materials passing between the rolls. Thus, the upper hardness limit of 100 durometer for the resilient roll is based on the desire to have at least the required elasticity to provide continuous engagement and to prevent breakage of the material being processed due to non-uniform excessive pressures.

During use, the resilient roll 19 always carries the cut complementary pattern of the pyramids 35 of roll 18. At the same time, the diameter decreases or is worn away. Hence, it appears that the lower roll is gradually and continuously re-cut during use.

Depending upon the hardness of the yarns being treated, there may be wear of the surfaces of rolls 18 and 19 in the areas of contact with the yarns. If such wear occurs, the pattern in such areas will be partially reduced with consequent decrease in texturization. To avoid this wear if it occurs, reed 14 may be connected to a traverse mechanism, not shown. This would provide reciprocal movement of the yarn, for example, with one-half inch travel, or something greater than the spacing between the yarns in a horizontal direction perpendicular to the movement of the yarns 12 through rolls 18 and 19. In this manner, the yarns contact a broad portion of the surface of rolls 18 and 19, and the wear across such broad surface will be uniform.

FIG. 3 depicts a method of prehating yarns 12 before they reach the nip of rolls 18 and 19. As shown in this drawing, overfeed assembly rolls 16 and 17 are provided with rotary couples 36 and 37, respectively. Couples 36 and 37 communicate respectively with hollow shafts 38 and 39 of the rolls, and are provided with heated fluid through hoses 40 and 41 from a source not shown. In this manner, the yarns may be heated prior to contact with rolls 18 and 19 and the speed of rotation of rolls 18 and 19 may be increased, thereby providing increased production. With sufficient preheat, it may be possible to avoid heating roll 18 in certain types of operation.

The synthetic yarns used in the present invention can be made of continuous filaments or spun from staple fibers. Additionally, the reeds of the apparatus illustrated in the drawings can be removed and the apparatus can be used to treat a web or sliver of synthetic staple fibers. After such treatment the staple fibers can be spun into yarn. The yarns and fibers can be made of a variety of synthetic thermoplastic polymeric materials such as nylon, polyester, acrylic and olefin fibrous materials. The term "synthetic fibrous textile materials" as used in the present specification and claims refers to continuous and spun yarns and staple fibers made from synthetic polymers.

When a web or sliver of staple fibers is treated it is not necessary to overfeed the textile material to the pressure rolls 18 and 19 nor to operate the take-up assembly **16*a* at a slower speed than roll 18. Thus, the overfeed mechanism 15 and the take-up assembly 16*a* can be eliminated or operated at the same speed as roll 18**.

When the material is treated by the pressure surfaces, it must be at a temperature which is at least sufficient to permit the material to undergo deformation. Generally, a temperature of at least about 250° F. is used. The maximum temperature should be less than that at which destruction or decomposition of the synthetic material occurs. The material to be treated can be heated by any suitable means, either before it passes between the pressure surfaces which deform it or while it is physically pressed between the surfaces and undergoing deformation.

In carrying out the processes of this invention, the textile material being treated can be deformed between the opposed pressure surfaces at a wide variation of applied pressure. The particular amount of pressure should be at least enough to ensure that the material is made to conform to the patterns of the opposed surfaces. At the same time, the material should not have so much pressure applied thereto that is is physically damaged by contact between the surfaces. Generally speaking, applied pressure in a range of about 200 to 1000 pounds per linear inch of the roll is sufficient in most cases to achieve the desired object. On the other hand, it is to be noted that the most suitable pressure necessary for processing of any particular fiber is readily determinable and is limited mainly by physical limitations of the apparatus or physical limitations of the fibrous material itself.

After deformation of the textile material between pressure surfaces, the material is removed while being maintained at a tension which does not pull out or remove a substantial amount of the deformation. When the textile material is yarn, it is preferably removed in a substantially tensionless state. When the textile material is a web or sliver of staple fibers no special steps to control tension are necessary. After removal from the pressure surfaces the fibrous material is cooled to set it in the deformed configuration. Cooling can be carried out at ambient temperature or positive cooling means can be used.

EXAMPLE 1

An apparatus similar to that shown in FIG. 1 was used with roll 18, having a pattern of raised pyramids such as shown in FIG. 4 in which there were 220 pyramids per inch. The base of each pyramid was a square, the sides of which were 100 microns in length and formed a 45° angle with the direction of yarn travel. The tops of the pyramids were truncated so that each truncated pyramid was 30 microns high and had a square top 25 microns on each side. There was no circulation of heated fluid through rolls 16 and 17 nor circulation of coolant through rolls 26 and 27. Roll 18 was made of steel and was heated to a temperature of 345° F. Roll 19 was a composition roll of 84 durometer hardness. No finishing operation was carried out and the yarns were fed directly from rolls 26 and 27 to beam 33.

A sheet of 1172 ends of 70 denier, 34 filament nylon yarn was fed by rolls 16 and 17 at a linear speed of 49.9 yds./min. The peripheral speed of roll 18 was 49.5 yds./min. and the pressure between rolls 18 and 19 was about 600 lbs./linear inch. The yarn forwarding speed of take-up assembly **16*a* was 47.1 yds./min. and there was no tension on the yarn between the pressure rolls 18 and 19 and the take-up assembly. The yarns were wound on beam 33** at a speed of 48.1 yds./min.

Fabric woven from the above-treated yarns had a soft, dry hand as compared to the slick, harsh hand of fabrics made from the same type of yarns which had not been textured by the above procedure.

EXAMPLE 2

The apparatus of Example 1 was used to treat a sheet of 1508 ends of 70 denier, 34 filament polyester yarn. The temperature of roll 18 was 345° F. and the pressure between rolls 18 and 19 was about 500 lbs./linear inch. The yarn was fed by rolls 16 and 17 at a speed of 50.3 yds./min., the peripheral speed of roll 18 was 50.0 yds./min., the speed of take-up assembly **16*a* was 43.3 yds./min. and the wind-up speed of beam 33** was 47.0 yds./min. Fabric woven from the treated yarn had a soft, dry hand.

EXAMPLE 3

An apparatus similar to that of Example 1, but with the reeds removed was used to treat a 0.5 oz./sq.yd. web of 1.5 denier by 1.5 inch length polyester staple fibers. The pattern of roll 18 was similar to that used in Example 1 except that it contained 180 pyramids per linear inch. Each pyramid had a square base, 130 microns on each side, a height of 36 microns and a square truncated top, 20 microns on each side. The temperature of roll 18 was 350° F. and the pressure between rolls 18 and 19 was 400 lbs./linear inch. The peripheral speed of roll 18 was 10 yds./min. and both the overfeed mechanism 15 and the take-up assembly 16*a* were bypassed.

The treated fibers were spun into yarn. Fabrics woven from this yarn had a soft, dry hand.

It will be apparent that many modifications and variations can be effected without departing from the scope of the novel concepts of the present invention and the illustrative details disclosed are not to be construed as imposing undue limitations on the invention.

I claim:

1. A process for texturing a plurality of synthetic fibrous textile materials, which are in the form of yarns or staple fibers, comprising feeding said textile materials between a set of opposed pressure surfaces while heating said textile materials, one of said surfaces being made of nonresilient material having thereon a raised pattern of closely spaced pyramids wherein the tops of the pyramids are truncated or rounded off and the other surface being made of a resilient material having a pattern of pyramid shaped depressions complementary to the pattern of said first surface whereby each of said textile materials is textured in a random sequence of deformations as different portions of the pyramid pattern sequentially act on each of said textile materials, removing said textile materials from between said pressure surfaces and cooling the textile materials to give a textured product having permanent distortions therein.

2. A process as claimed in claim 1 wherein said pattern of pyramids has at least 100 pyramids per linear inch.

3. A process as claimed in claim 1 wherein the base of each of said pyramids is a rectangle, the sides of which are at an angle of 45° to the feeding direction of said textile materials.

4. A process as claimed in claim 1 wherein said fibrous textile materials are staple fibers and after permanent distortions are imparted therein, said staple fibers are formed into spun yarns.

5. A process as claimed in claim 1 wherein said fibrous textile materials are continuous filament yarns which are overfed to said pressure surfaces and then removed from between said pressure surfaces under a controlled tension which does not pull out the deformations in said yarns imparted by said pressure surfaces.

6. A process as claimed in claim 1 wherein said set of opposed pressure surfaces are pressure rolls.

7. A process for texturing a plurality of synthetic yarns comprising feeding said yarns between a set of two opposed rotating pressure rolls while heating said yarns, one of said rolls being made of nonresilient material having thereon a raised pattern of closely spaced pyramids in which the tops of the pyramids are truncated or rounded off and the other roll being made of a resilient material having a pattern of pyramid shaped depressions complementary to the pattern of said first roll whereby each of said yarns is textured in a random sequence of deformations as different portions of the pyramid pattern sequentially act on each of said yarns, removing said yarns from between said pressure rolls while maintaining the yarns under a controlled tension which does not pull out said deformations, and cooling the yarns while maintained under said controlled tension to give a textured product having permanent distortions therein.

8. A process as claimed in claim 7 wherein said pattern of pyramids has at least 100 pyramids per linear inch.

9. A process as claimed in claim 8 wherein the base of each of said pyramids is a rectangle, the sides of which are at an angle of 45° to the feeding direction of said textile materials.

10. A process as claimed in claim 8 wherein said pressure roll of nonresilient material is a driven roll and said yarns are fed to said pressure rolls at a speed at least 0.3% greater than the peripheral speed of said driven pressure roll.

11. A process for producing spun yarns comprising feeding a web or sliver of synthetic staple fibers between a set of two opposed rotating pressure rolls while heating said staple fiber, one of said rolls being made of nonresilient material having thereon a raised pattern of closely spaced pyramids in which the tops of the pyramids are truncated or rounded off and the other roll being made of a resilient material having a pattern of pyramid-shaped depressions complementary to the pattern of said first roll whereby each of said staple fibers is textured in a random sequence of deformations as different portions of the pyramid pattern sequentially act on each of said staple fibers, removing said staple fibers from between said pressure rolls, cooling the staple fibers to give a textured product having permanent distortions therein, and forming said staple fibers into spun yarn.

12. A process as claimed in claim 11 wherein said pattern of pyramids has at least 100 pyramids per linear inch.

* * * * *